US011437711B2

(12) United States Patent
Hang et al.

(10) Patent No.: US 11,437,711 B2
(45) Date of Patent: Sep. 6, 2022

(54) ANTENNA MODULE AND MOBILE TERMINAL

(71) Applicant: AAC Technologies Pte. Ltd., Singapore (SG)

(72) Inventors: Mingjun Hang, Shenzhen (CN); Kai Dong, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 22 days.

(21) Appl. No.: 16/996,934

(22) Filed: Aug. 19, 2020

(65) Prior Publication Data

US 2021/0036408 A1 Feb. 4, 2021

Related U.S. Application Data

(63) Continuation of application No. PCT/CN2019/093950, filed on Jun. 29, 2019.

(51) Int. Cl.

| | |
|---|---|
| ***H01Q 1/36*** | (2006.01) |
| ***H01Q 1/24*** | (2006.01) |
| ***H01Q 9/04*** | (2006.01) |
| ***H01Q 21/00*** | (2006.01) |
| ***H01Q 21/06*** | (2006.01) |

(52) U.S. Cl.

CPC ..... *H01Q 1/243* (2013.01); *H01Q 9/0421* (2013.01); *H01Q 21/0025* (2013.01); *H01Q 21/065* (2013.01)

(58) Field of Classification Search

CPC .. H01Q 1/243; H01Q 9/0421; H01Q 21/0025; H01Q 21/065; H01Q 1/38; H01Q 1/40; H01Q 9/42; H01Q 1/22; H01Q 1/48; H01Q 1/50

See application file for complete search history.

(56) References Cited

U.S. PATENT DOCUMENTS

2001/0040529 A1* 11/2001 Cheng ..... G06F 1/1616 343/702
2003/0030587 A1* 2/2003 Yuasa ..... H01Q 9/0407 343/700 MS
2004/0169606 A1* 9/2004 Sato ..... H01Q 1/38 343/702
2006/0145923 A1* 7/2006 Autti ..... H01Q 1/243 343/702

(Continued)

FOREIGN PATENT DOCUMENTS

JP 2004096314 A * 3/2004 ..... H01Q 1/24

*Primary Examiner* — Dimary S Lopez Cruz
*Assistant Examiner* — Bamidele A Jegede
(74) *Attorney, Agent, or Firm* — W&G Law Group

(57) ABSTRACT

The present disclosure provides an antenna module and a mobile terminal. The antenna module includes a dielectric block and a radiation patch. The dielectric block is a polyhedron, the radiation patch is attached to a plurality of surfaces of the dielectric block, and the radiation patch is provided with a feed point and a ground point. The mobile terminal is provided with several antenna modules described above. The antenna module provided in the present disclosure attaches the radiation patch to the plurality of surfaces of the dielectric block with a polyhedral structure, thereby reducing an overall volume of the antenna module while increasing an effective radiation area of the radiation patch and enhancing radiation performance of the antenna module.

14 Claims, 6 Drawing Sheets

(56) References Cited

U.S. PATENT DOCUMENTS

2006/0152419 A1* 7/2006 Sato ..... H01Q 9/42 343/702
2007/0040747 A1* 2/2007 Kinezos ..... H01Q 13/085 343/702
2007/0159398 A1* 7/2007 Tsai ..... H01Q 5/357 343/700 MS
2007/0236391 A1* 10/2007 Ryou ..... H01Q 1/36 343/700 MS
2008/0204340 A1* 8/2008 Kim ..... H01Q 5/371 343/770
2009/0243940 A1* 10/2009 Humphrey ..... H01Q 9/0414 343/700 MS
2009/0256771 A1* 10/2009 Onaka ..... H01Q 9/42 343/700 MS
2010/0141536 A1* 6/2010 Zhang ..... H01Q 9/42 343/702
2011/0018770 A1* 1/2011 Tang ..... H01Q 5/364 343/700 MS
2011/0031821 A1* 2/2011 Greene ..... H01Q 1/2225 307/154
2011/0043408 A1* 2/2011 Shi ..... H01Q 1/48 343/700 MS
2012/0229345 A1* 9/2012 Takaki ..... H01Q 1/2291 343/700 MS
2013/0038494 A1* 2/2013 Kuonanoja ..... H01Q 9/42 343/746
2013/0050050 A1* 2/2013 Zhu ..... H01Q 1/2291 343/866
2013/0241798 A1* 9/2013 Lee ..... H01Q 1/50 343/876
2013/0300615 A1* 11/2013 Wong ..... H01Q 1/243 343/702
2013/0324056 A1* 12/2013 Maguire ..... H01Q 1/2291 455/73
2014/0071022 A1* 3/2014 Na ..... H01Q 9/42 343/904
2014/0100004 A1* 4/2014 Yarga ..... H01Q 1/38 455/575.8
2014/0198012 A1* 7/2014 Tseng ..... H01Q 21/28 343/876
2014/0361948 A1* 12/2014 Tanaka ..... H01Q 1/38 343/861
2015/0380825 A1* 12/2015 Ryu ..... H01Q 9/42 343/727
2016/0049720 A1* 2/2016 Hwang ..... H01Q 1/243 343/702
2016/0336649 A1* 11/2016 Yu ..... H01Q 1/38
2017/0025738 A1* 1/2017 Lee ..... H01Q 1/243
2017/0047651 A1* 2/2017 Zuniga ..... H01Q 1/243
2017/0365914 A1* 12/2017 Hong ..... H04B 1/0064
2018/0294553 A1* 10/2018 Lim ..... H01Q 1/48
2018/0323496 A1* 11/2018 Lee ..... H01Q 9/145
2019/0097314 A1* 3/2019 Rajagopalan ..... H01Q 1/521
2019/0165454 A1* 5/2019 Lee ..... H01Q 1/243

* cited by examiner

ANTENNA MODULE AND MOBILE TERMINAL

TECHNICAL FIELD

The present disclosure relates to the field of communication technology, in particular to an antenna module and a mobile terminal.

BACKGROUND

With the development of the times, wireless mobile terminals such as mobile phones, portable wireless routers, wireless network adapters, and tablet computers have become an important part of people's life.

These wireless mobile terminals need to receive or send wireless signals through the antenna module. However, as users put forward higher requirements for the portability of wireless mobile terminals, the existing wireless mobile terminals is required to have smaller volume while realizing corresponding functions.

Due to the requirements for the portability of wireless mobile terminals and with the coming of 5G era, how to make the antenna module achieve better signal transmission in a limited volume so that the antenna module may be adapted to a variety of wireless mobile terminals is a technical problem to be solved urgently by those skilled in the art.

SUMMARY

The present disclosure provides an antenna module and a mobile terminal, aiming to enable the antenna module to realize better signal transmission in a limited volume.

In order to achieve the above objective, the present disclosure provides an antenna module, including a dielectric block and a radiation patch. The dielectric block is a polyhedron, the radiation patch is attached to a plurality of surfaces of the dielectric block, and the radiation patch is provided with a feed point and a ground point.

As an improvement, the antenna module further includes an encapsulating layer. The encapsulating layer covers the radiation patch, and the feed point and the ground point are exposed from the encapsulating layer.

As an improvement, the dielectric block is a hexahedron, the radiation patch is attached to six surfaces of the dielectric block, and the feed point and the ground point are arranged on the same surface.

As an improvement, the antenna module has a length of 8 mm, a width of 4 mm and a height of 2.5 mm.

In order to achieve the above objective, the present disclosure provides a mobile terminal, including a housing, a main board fixed to the housing and a battery electrically connected to the main board. The mobile terminal is further provided with the antenna module described above. Several antenna modules are provided and are distributed on opposite sides of the battery.

As an improvement, the several antenna modules are assembled to a flexible circuit board and are fed through the flexible circuit board.

As an improvement, four antenna modules are provided, and the four antenna modules are arranged on opposite sides of the battery in pairs.

As an improvement, several clearance areas are provided on opposite sides of the main board or the housing in a second direction. The antenna modules are correspondingly arranged in the several clearance areas.

As an improvement, lengths of the several clearance areas are greater than or equal to 12 mm and widths of the several clearance areas are greater than or equal to 3.5 mm.

As an improvement, the several antenna modules are formed as a MIMO antenna module.

Compared with the existing technology, the antenna module and the mobile terminal provided in the present disclosure have the following advantages.

1. The antenna module includes the dielectric block and the radiation patch. The dielectric block is the polyhedron, the radiation patch is attached to the plurality of surfaces of the dielectric block, and the radiation patch is provided with the feed point and the ground point. The antenna module attaches the radiation patch to the plurality of surfaces of the dielectric block with a polyhedral structure, thereby reducing an overall volume of the antenna module while increasing an effective radiation area of the radiation patch and enhancing radiation performance of the antenna module.

2. By setting the encapsulating layer, the encapsulated antenna module may be adapted to various mobile terminals.

DETAILED DESCRIPTION

In order to make objectives, technical solutions and advantages of the present disclosure clearer, some embodiments of the present disclosure will be explained below in detail with reference to the accompanying drawings and embodiments. It should be understood that the specific embodiments described here are only used to explain but not to limit the present disclosure.

Figure 1A:
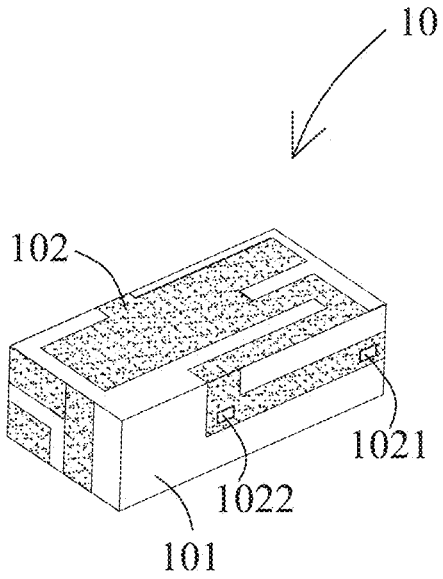
FIG. 1A is a schematic diagram of a three-dimensional structure of an antenna module from a first perspective provided in the present disclosure.
Figure 1B:
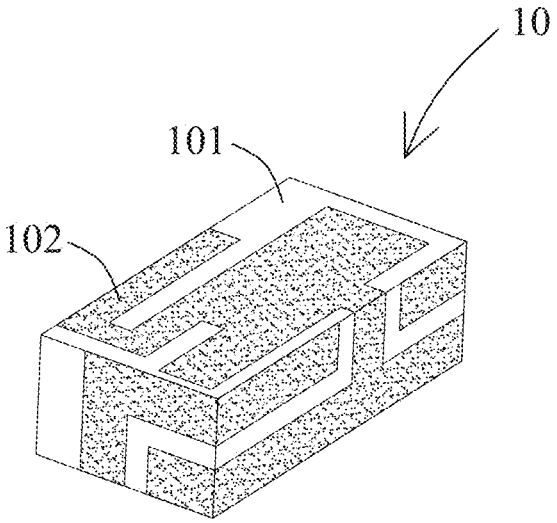
FIG. 1B is a schematic diagram of a three-dimensional structure of an antenna module from a second perspective provided in the present disclosure.
Figure 1C:
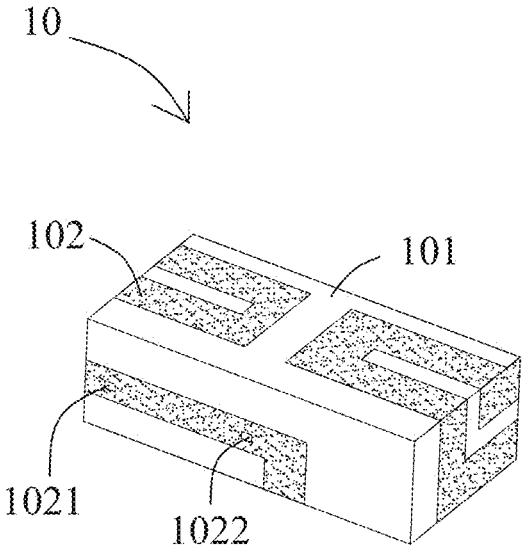
FIG. 1C is a schematic diagram of a three-dimensional structure of an antenna module from a third perspective provided in the present disclosure.

Referring to FIG. 1A to FIG. 1C, a first embodiment of the present disclosure provides an antenna module 10. The antenna module 10 includes a dielectric block 101 and a radiation patch 102. Herein, the dielectric block 101 is a polyhedron, and the polyhedron may be a trihedron, tetrahedron, pentahedron or hexahedron. The radiation patch 102 is attached to a plurality of surfaces of the dielectric block 101 so as to use the dielectric block 101 in a limited space, thereby reducing a volume of the antenna module 10 while increasing an effective radiation area of the radiation patch 102 and enhancing radiation performance of the antenna module 10.

The radiation patch 102 is provided with a feed point 1021 and a ground point 1022, so that the antenna module 10 is fed through electrically connecting the feed point 1021 and the ground point 1022 with a feed network.

In this embodiment, the dielectric block 101 has a hexahedral structure. The radiation patches 102 are attached to six surfaces of the dielectric block 101, and the feed point 1021 and the ground point 1022 are arranged on the same surface of the dielectric block 101.

It can be understood that the radiation patch 102 attached to the surface of the dielectric block 101 may form a radiation pattern thereon through processes such as etching and stamping. The radiation pattern may be any one or a combination of ordered stripes, annular blocks and polygonal blocks, or may be any one or a combination of staggered stripes, annular blocks and polygonal blocks.

Figure 2:
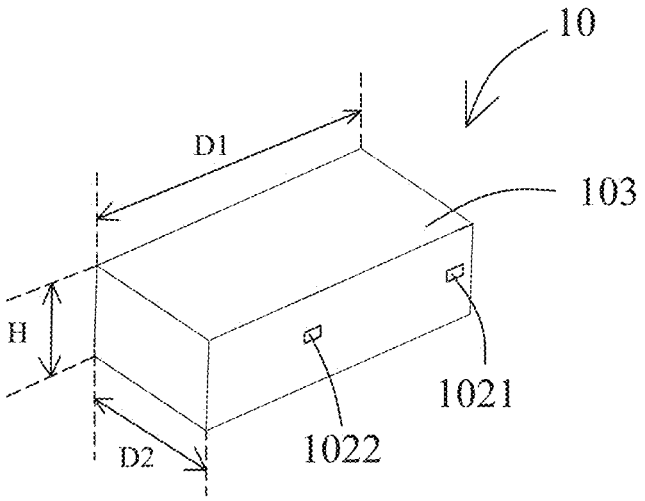
FIG. 2 is a schematic diagram of a three-dimensional structure of a modified structure of an antenna module provided in the present disclosure.

Referring to FIG. 2, in some embodiments, the antenna module 10 further includes an encapsulating layer 103. The encapsulating layer 103 covers the radiation patch 102 and exposes the feed point 1021 and the ground point 1022 from the encapsulating layer 103.

The encapsulated antenna module 10 has a length D1, a width D2 and a height H. Herein, the length D1 is 7.5 to 8.5 mm, and preferably, the length D1 is 8 mm. The width D2 is 3.5 to 4.5 mm, and preferably, the width D2 is 4 mm. The height H is 2 to 3 mm, and preferably, the height H is 2.5 mm.

The encapsulated antenna module 10 may be adapted to various mobile terminals such as mobile phones, wireless network adapters and routers, so that various mobile terminals may better realize reception and transmission of wireless signals.

Figure 3:
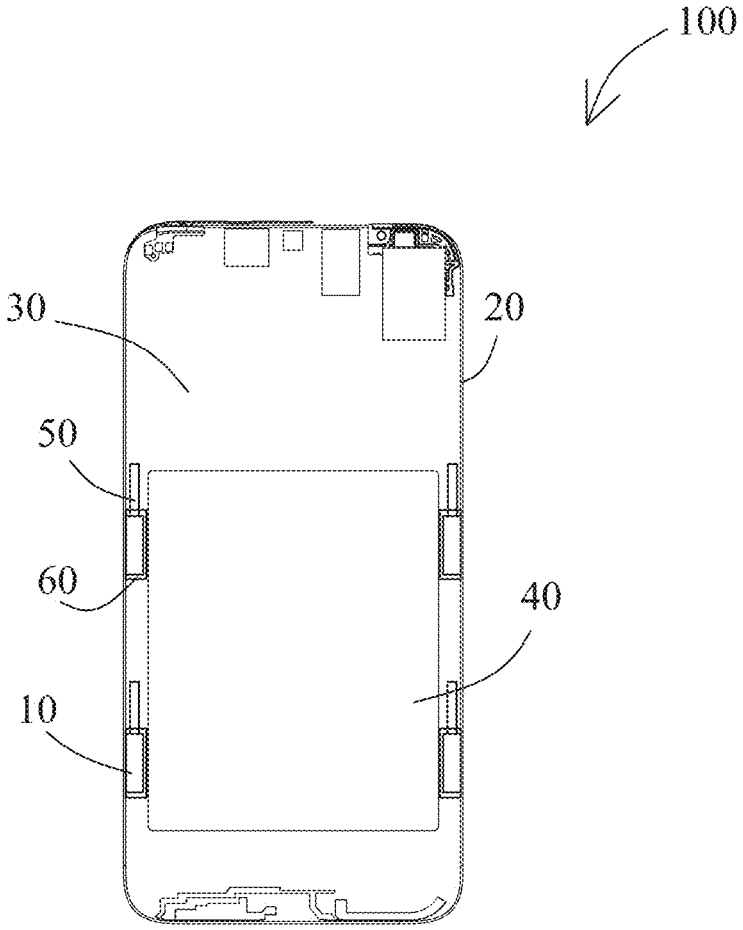
FIG. 3 is a schematic structural diagram of an antenna module arranged on a mobile terminal.

Referring to FIG. 3, a second embodiment of the present disclosure provides a mobile terminal 100. The mobile terminal 100 includes a housing 20, a main board 30 fixed to the housing 20, a battery 40 electrically connected to the main board 30, and several antenna modules 10. The several antenna modules 10 are distributed on opposite sides of the battery 40 and electrically connected to the battery 40. Herein, the several antenna modules 10 are formed as a MIMO antenna module.

In some embodiments, the mobile terminal further includes a flexible circuit board 50. The several antenna modules 10 are assembled to the flexible circuit board 50 and are fed through the flexible circuit board 50.

In some embodiments, there are four antenna modules 10, which are arranged on opposite sides of the battery 10 in pairs to form a 4*4 MIMO antenna module.

In some embodiments, several clearance areas 60 are arranged on opposite sides of the main board 30 or the housing 20. Lengths of the several clearance areas 60 are greater than or equal to 12 mm, and widths of the several clearance areas are greater than or equal to 3.5 mm. The antenna modules 10 are correspondingly arranged in the several clearance areas 60. Herein, the clearance area 60 is an area where no other electronic component is provided.

Figure 4:
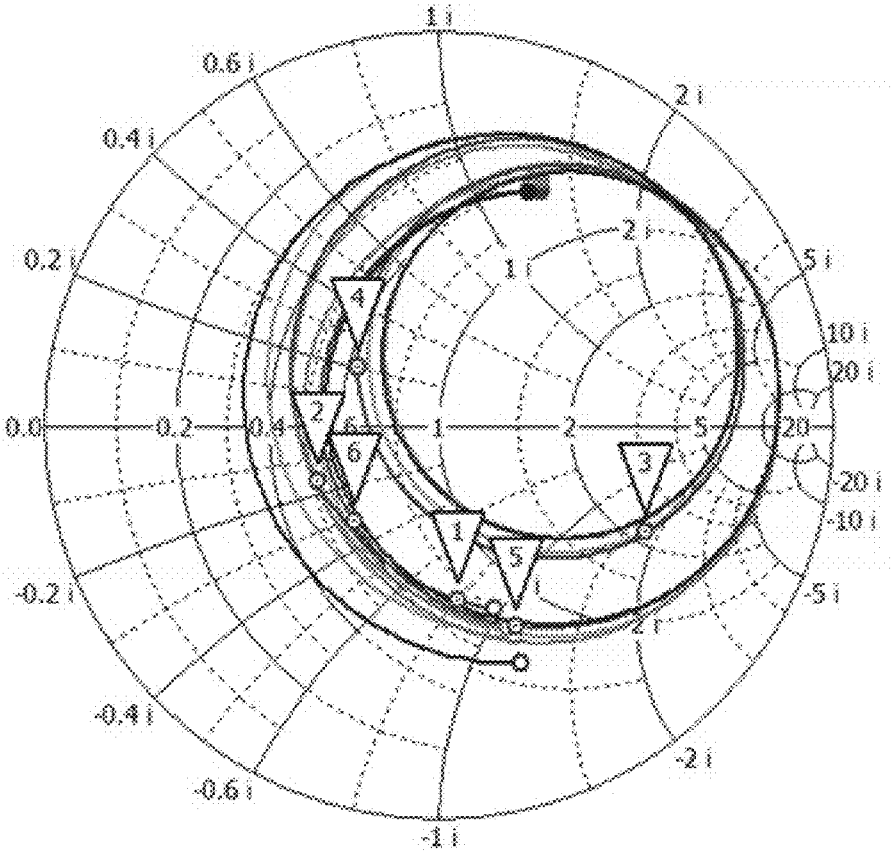
FIG. 4 is a Smith chart of an antenna module in a mobile terminal.
Figure 5:
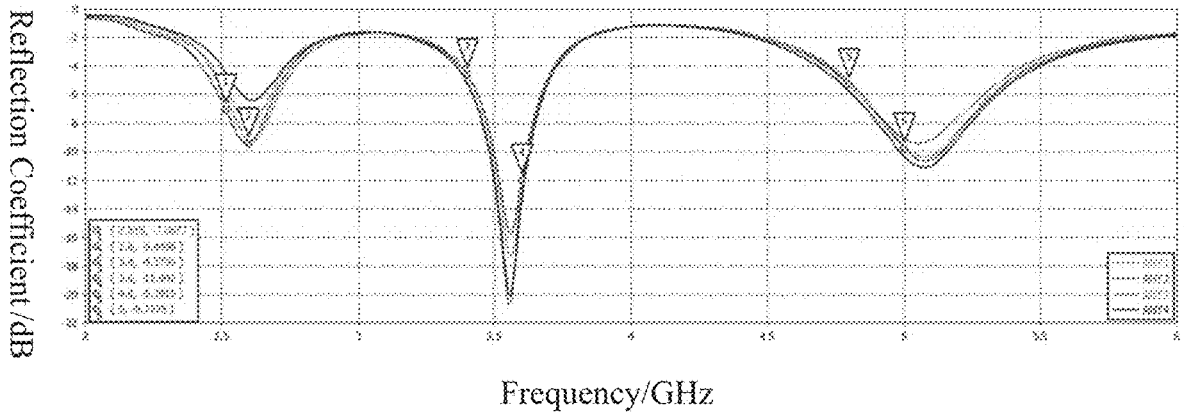
FIG. 5 is an S-parameter graph of an antenna module in a mobile terminal.
Figure 6:
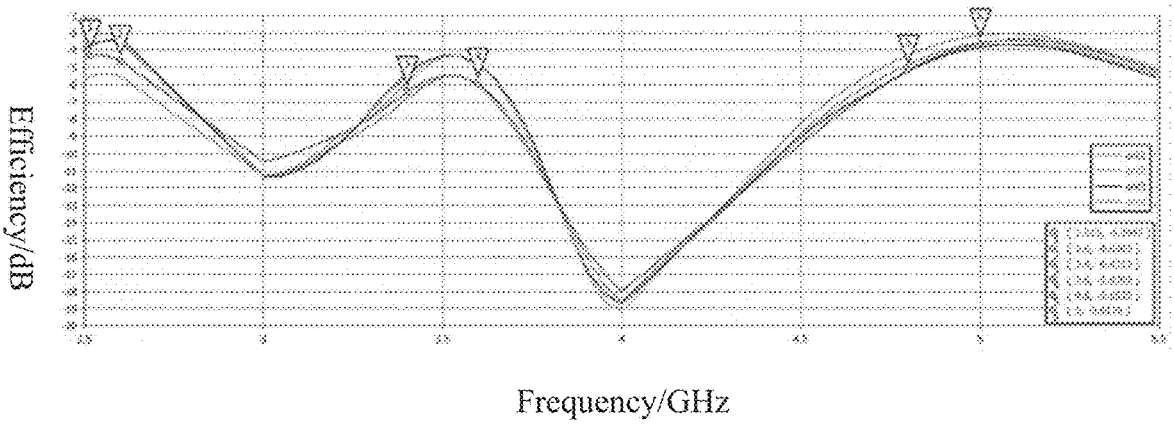
FIG. 6 is an efficiency diagram of an antenna module in a mobile terminal.

Refer to FIG. 4 to FIG. 6 for antenna performance of the antenna module 10 in the mobile terminal 100.

Herein, FIG. 4 is a Smith chart of the antenna module 10 in the mobile terminal 100.

FIG. 5 is an S-parameter graph of the antenna module 10 in the mobile terminal 100.

FIG. 6 is an efficiency diagram of the antenna module 10 in the mobile terminal 100.

Compared with the existing technology, the antenna module and the mobile terminal provided in the present disclosure have the following advantages.

1. The antenna module includes the dielectric block and the radiation patch. The dielectric block is the polyhedron, the radiation patch is attached to the plurality of surfaces of the dielectric block, and the radiation patch is provided with the feed point and the ground point. The antenna module attaches the radiation patch to the plurality of surfaces of the dielectric block with a polyhedral structure, thereby reducing an overall volume of the antenna module while increasing an effective radiation area of the radiation patch and enhancing a radiation performance of the antenna module.

2. By setting the encapsulating layer, the encapsulated antenna module may be adapted to various mobile terminals.

The above description is merely embodiments of the present disclosure. It should be noted that those of ordinary skills in the art may make improvements without departing from the inventive concept of the present disclosure, however, such improvements fall within the protection scope of the present disclosure.

What is claimed is:

1. An antenna module, comprising a one-piece dielectric block, a radiation patch and an encapsulating layer; wherein the dielectric block is a polyhedron and have a plurality of surfaces, the radiation patch is attached to each of the plurality of surfaces of the dielectric block, and the radiation patch is provided with a feed point and a ground point; the encapsulating layer is attached to each of the plurality of surfaces of the dielectric block and covers the radiation patch, and the feed point and the ground point are exposed from the encapsulating layer.

2. The antenna module according to claim 1, wherein the dielectric block is a hexahedron, the radiation patch is attached to six surfaces of the dielectric block, and the feed point and the ground point are arranged on the same surface.

3. The antenna module according to claim 2, wherein the antenna module has a length of 8 mm, a width of 4 mm and a height of 2.5 mm.

4. A mobile terminal, comprising a housing, a main board fixed to the housing and a battery electrically connected to the main board; wherein the mobile terminal is further provided with the antenna module according to claim 2; several antenna modules are provided and are distributed on opposite sides of the battery.

5. The mobile terminal according to claim 4, wherein the several antenna modules are assembled to a flexible circuit board and are fed through the flexible circuit board.

6. The mobile terminal according to claim 4, wherein four antenna modules are provided and the four antenna modules are arranged on opposite sides of the battery in pairs.

7. The mobile terminal according to claim 4, wherein the several antenna modules are formed as a MIMO antenna module.

8. The mobile terminal according to claim 4, wherein several clearance areas are provided on opposite sides of the main board or the housing, and the antenna modules are correspondingly arranged in the several clearance areas.

9. A mobile terminal, comprising a housing, a main board fixed to the housing and a battery electrically connected to the main board; wherein the mobile terminal is further provided with the antenna module according to claim 1; several antenna modules are provided and are distributed on opposite sides of the battery.

10. The mobile terminal according to claim 9, wherein the several antenna modules are assembled to a flexible circuit board and are fed through the flexible circuit board.

11. The mobile terminal according to claim 9, wherein four antenna modules are provided and the four antenna modules are arranged on opposite sides of the battery in pairs.

12. The mobile terminal according to claim 9, wherein the several antenna modules are formed as a MIMO antenna module.

13. The mobile terminal according to claim 9, wherein several clearance areas are provided on opposite sides of the main board or the housing, and the antenna modules are correspondingly arranged in the several clearance areas.

14. The mobile terminal according to claim 13, wherein lengths of the several clearance areas are greater than or equal to 12 mm and widths of the several clearance areas are greater than or equal to 3.5 mm.

* * * * *